US008220635B2

(12) United States Patent
Kaplan et al.

(10) Patent No.: US 8,220,635 B2
(45) Date of Patent: Jul. 17, 2012

(54) BLISTER BELT FOR RECEIVING MEDICAL AND/OR PHARMACEUTICAL AND/OR FOOD SUPPLEMENT PRODUCTS

(75) Inventors: Horst Kaplan, Oerlingen (DE); Stefan Kemner, Harsewinkel (DE); Christoph Hammer, Gams (CH)

(73) Assignee: AvidiaMed GmbH, Hamburg (DE)

( * ) Notice: Subject to any disclaimer, the term of this patent is extended or adjusted under 35 U.S.C. 154(b) by 1 day.

(21) Appl. No.: 12/675,325

(22) PCT Filed: Aug. 30, 2008

(86) PCT No.: PCT/EP2008/007211

§ 371 (c)(1),
(2), (4) Date: Apr. 21, 2010

(87) PCT Pub. No.: WO2009/030475

PCT Pub. Date: Mar. 12, 2009

(65) Prior Publication Data

US 2010/0300924 A1 Dec. 2, 2010

(30) Foreign Application Priority Data

Aug. 30, 2007 (EP) ..... 07075763

(51) Int. Cl.
*B65D 83/04* (2006.01)

(52) U.S. Cl. ..... 206/534.1; 206/390; 206/538

(58) Field of Classification Search ..... 206/461, 206/469, 528, 531, 532, 534.1, 538, 539, 206/390

See application file for complete search history.

(56) References Cited

U.S. PATENT DOCUMENTS

| | | | | |
|---|---|---|---|---|
| 3,311,229 | A * | 3/1967 | Troll et al. | 206/461 |
| 3,380,578 | A * | 4/1968 | Sparks | 206/484 |
| 4,429,792 | A * | 2/1984 | Machbitz | 206/531 |
| 4,574,954 | A | 3/1986 | Reid | |
| D306,825 | S * | 3/1990 | Siegel | D9/732 |

(Continued)

FOREIGN PATENT DOCUMENTS

DE 198 35 940 2/2000

(Continued)

OTHER PUBLICATIONS

International Search Report of PCT/EP2008/007211 Dated Dec. 10, 2008 w/ English Translation.

(Continued)

*Primary Examiner* — David Fidei
(74) *Attorney, Agent, or Firm* — Venable LLP; Robert Kinberg; Leigh D. Thelen

(57) ABSTRACT

A blister strip for receiving medical and/or pharmaceutical and/or food supplement products, includes a roll-up single-web product carrier that can be divided into individual blister sections. The single-web product carrier has individual nests, one behind the other in its direction of transport defining a division of the blister strip for receiving single products, as well as a film-like cover for closing the nests. Each product is arranged in sealed form within a nest. Each nest has a holding chamber formed with two steps and a depression independent of the product geometry and a depression dependent on the product geometry. The depth of the product-independent depression starting from the cover on the one hand being so great that the blister strip can be laterally guided mechanically along the product-independent depression, and on the other hand being less than the thickness of the smallest product to be received within the nest.

14 Claims, 4 Drawing Sheets

U.S. PATENT DOCUMENTS

Figure 1:
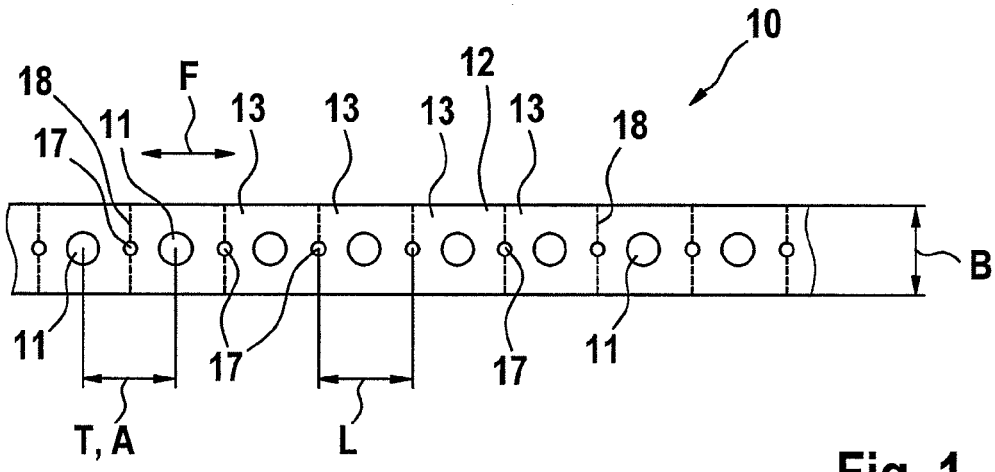

| | | | | |
|---|---|---|---|---|
| 5,954,204 | A * | 9/1999 | Grabowski | 206/531 |
| 6,244,442 | B1 | 6/2001 | Inoue et al. | |

FOREIGN PATENT DOCUMENTS

| | | | |
|---|---|---|---|
| DE | 199 38 298 | | 2/2001 |
| DE | 202 04 067 | | 7/2003 |
| EP | 563935 | A2 * | 10/1993 |
| GB | 2052426 | A * | 1/1981 |
| WO | WO 8907928 | A1 * | 9/1989 |
| WO | WO-99/011011 | | 1/1999 |
| WO | WO-03/055770 | | 7/2003 |
| WO | WO-2005/104948 | | 11/2005 |

OTHER PUBLICATIONS

Written Action from the International Seach Office w/ English Translation.

* cited by examiner

BLISTER BELT FOR RECEIVING MEDICAL AND/OR PHARMACEUTICAL AND/OR FOOD SUPPLEMENT PRODUCTS

CROSS-REFERENCE TO RELATED APPLICATIONS

This application is a National Stage Application of PCT/EP2008/007211, filed Aug. 30, 2008, which designates the United States and claims the priority of European Patent Application No. 07075763.8, filed on Aug. 30, 2007.

BACKGROUND OF THE INVENTION

The invention concerns a blister strip for receiving medical and/or pharmaceutical and/or food supplement products, comprising a roll-up product carrier that can be divided into individual blister sections, the single-web product carrier having, one behind the other in its direction of transport F, individual nests defining the division T of the blister strip for receiving single products, as well as a film-like cover for closing the nests, such that each product is arranged in sealed form within one nest.

Blister strips of this kind are used in particular in the manufacture of packs individual to the patient (patient-individual packs). Such packs can be made manually or in automated fashion. In the process, from individual rolled-up blister strips which are preferably each provided with one product type, sections with a single product or several products are unrolled, separated from the blister strip and positioned on a substrate and, if necessary, attached e.g. by gluing or the like. Usually, the blister strip is arranged in sandwich fashion between the substrate and a cover element. The cover element has openings through which the nests at least partially protrude. The substrate is provided with perforations in the region of the products, so that, when the products are removed, the products are pushed through the film-like cover of the blister strip and through the partially weakened material of the substrate by exerting pressure on the nests.

Known blister strips as described for example in U.S. Pat. No. 6,244,442 B1 are designed individually with a single-stepped nest for each product or each type of product. Thus the blister strips and in particular also the nests designed for receiving the products have different geometries from one product to the next or from one product type to the next, depending on the product geometry. Concretely, for example the nests of tablets differ from those of oblongs or capsules in shape and size. Accordingly, the blister sections of different blister strips each carrying a product have different lengths and/or widths. With reference to an example, this means that a blister strip for product A has nests adapted to product A, while a blister strip for product B which has a geometry different to product A has nests adapted to product B, e.g. the blister sections of the blister strip carrying product A being longer than the blister sections of the blister strip carrying product B. Furthermore, the nests usually have a single, one-stepped holding chamber for each product. This means that the nest or the holding chamber is designed exclusively specifically to the product and in individualized fashion. In other words, the size of the opening for pushing out or emergence of the product from the nest corresponds to the size of the product.

From WO 99/01101 A2 is known e.g. a nest of oval shape in section for blisters, which is higher and wider than a product held in it. The nest has several steps to facilitate pushing a product out of the nest, with a plurality of peripheral shoulders. The plurality of peripheral shoulders is intended to guarantee the effect that, in case of continued pressing against the outer surface of the uppermost shoulder, the nest tends to crumple and the subsequent, lower shoulders are gradually pushed together by buckling. U.S. Pat. No. 4,574,954 is concerned with a blister strip which has lozenge-shaped nests in section which each comprise a single-stepped holding chamber. In addition to the holding chamber which receives the product, each nest is assigned a push-out area which, starting from the cover covering the holding chamber, is located behind the holding chamber.

Known blister strips are, for various reasons, disadvantageous to handle both during preferably automatic mounting on a substrate and when pushing the product out of the nest. Due to the different geometries of the blister strips or blister sections, automated mounting is possible only with considerable expenditure on measurement and control. In other words, the mounting head of an automatic mounting machine must in each case control individual collection positions for the blister sections separated from the blister strip. This leads to an increased mounting time as well as an increase in the number of mounting errors, which is to be avoided in the manufacture of patient-individual packs. Furthermore, the different geometries of the nests require corresponding adaptation in particular of the cover elements. To be more precise, individual nest sizes require individual openings or punched-out areas in the cover elements, which leads to an increased number of cover element formats. In addition to the extra costs for the different cover elements, there is also a logistics problem, namely stocking the different cover element formats in the region of the automatic mounting machines. A further problem of product-specific, individualized nest sizes lies in that small products are also assigned to only a small nest. The result is that, owing to the small contact pressure area, when the products are pushed out of the nests an increased effort is necessary, which cannot be applied by all users/patients. Also, due to the fact that the products in the known nests correspond to the size of the opening, it is made more difficult to push them out because the cover closing the nests has a high tension or holding force which must be overcome. This tension or holding force is all the greater, the smaller the cross-section spanned or the opening spanned. They are also made more difficult to push out by the fact that the strip material for the blister strip is thicker, the smaller the nest. A further drawback of the known blister strips lies in that within the nests there are large free spaces not filled by the products, so that there may be insufficient shelf life of the products due to trapped air.

SUMMARY

It is therefore an object of the present invention to provide a blister strip which ensures improved handling during automated manufacture of packs on the one hand and during "use" on the other hand.

The above and other objects may be achieved by a blister strip having the features mentioned hereinbefore according to the invention, wherein, according to an embodiment of the invention, each nest has a holding chamber formed with two steps, having a depression independent of the product geometry and a depression dependent on the product geometry, the depth D of the product-independent depression starting from the cover on the one hand being so great that the blister strip can be laterally guided mechanically along the product-independent depression, and on the other hand being less than the thickness of the smallest product to be received within the nest. This design ensures in a surprisingly simple manner that standardisation of the nests is achieved, leading firstly to improved automatic handling during the manufacture of a pack and secondly to improved handling during "use". Handling during "use" is in particular made easier by the double effect of the push-out aid achieved according to the invention. On the one hand, the longer leverage at each product when it is pushed out ensures smaller push-out forces. On the other hand, the shape of the nest and in particular of the product-independent depression leads to thinning of the nest wall, so that the resistance to being pushed in is lowered.

One embodiment provides that the product-independent depression may be larger in its cross-section running parallel to the cover than the product-dependent depression, so that pushing out the product and therefore handling are made easier. The cross-section parallel to the cover in this context means nothing other than the top view of the depression in the plane of the cover.

In another embodiment the product-independent depression may be identical for all products in its cross-sectional geometry running parallel to the cover. As a result, the product-independent depression on the one hand, which is also referred to as a standardised preliminary area, and the product-dependent depression on the other hand, which is also referred to as a product area, ensure that products having different product geometries are received in a standard blister, so that e.g. identical cover elements can be used for all products to be kept in stock, as a result of which the production costs can be reduced. A further advantage of the construction according to the invention lies in that the logistics costs can be reduced, as the number of elements/parts necessary for production, namely e.g. common cover elements for all products, is reduced.

In a further embodiment the depth D of the product-independent depression may be not less than about 1.2 mm and not more than about 2.5 mm. The minimum depth of about 1.2 mm of the product-independent depression ensures that the blister strips can still be guided mechanically. To put it another way, the side edge of the depression oriented vertically to the plane of transport forms a guide means during transport or during conveying of the blister strips, the minimum height of the side edge, which corresponds to the depth D of the depression, effectively preventing lateral shifting of the blister strips during transport or conveying. The maximum depth of the product-independent depression ensures that, after filling of the nest, products are located within the product-dependent depression and do not accidentally get into the region between the product-independent depression and the cover. To put it another way, the products are, as it were, fixed within the product-dependent depression due to the design or construction of the product-independent depression according to the invention.

A further appropriate embodiment is distinguished in that the cross-section of the product-independent depression running parallel to the cover may be geometrically shaped and designed to receive the most varied product types. This ensures that filling of the individual nests with products having different product geometries can be achieved with a small number of nest geometries. As a result, there is a reduction in the required number of format parts in manufacture or shaping of the nests.

The cross-section of the product-independent depression running parallel to the cover may correspond to a lozenge with rounded corners. The outer edge of the surface of the product-independent depression could also be described with an oval and a circle mounted centrally over it, the transitions between the oval web and the circle web being smoothed. This special geometry of the product-independent depression ensures that the most varied products, that is, e.g. maximally round flat or convex tablets, but also maximum-size tablets in oblong or capsule form can be packed in a blister strip. A further advantage lies in that the design and arrangement of the product-independent depression according to the invention leads to a saving of space in width and length of the blister strip, because orientation of the product-independent depression for optimum space is guaranteed.

The geometrical dimensions of the blister strip or blister sections may be independent of the product, so that in the manufacture of packs consisting of several blister strips with different products there is a common standard which substantially simplifies production. Regardless of the product or product geometry, a predefined collection position can be achieved, so that the measurement or control costs are avoided or greatly reduced.

Each nest may be assigned a first positioning aid, the position of the positioning aid being fixed relative to the nest. With the positioning aid, positioning and control of the blister strips or blister sections for example on automatic mounting machines or the like can be improved.

In another embodiment, each nest or each blister section may be assigned a code. This code enables identification of the products contained in the nests "accurate to a nest", which prevents erroneous mounting.

DETAIL DESCRIPTION OF THE DRAWINGS

Figure 2:
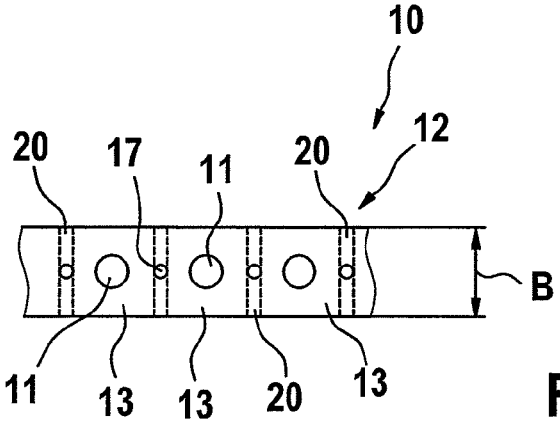
Figure 3:
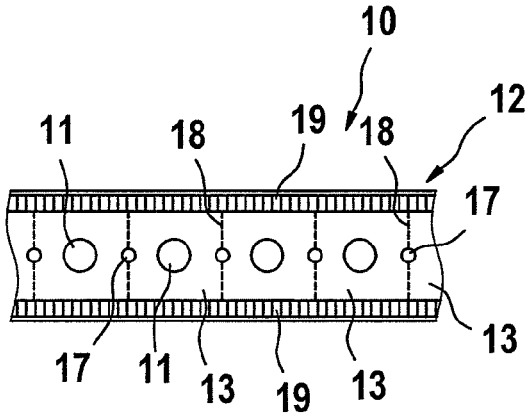
Figure 4:
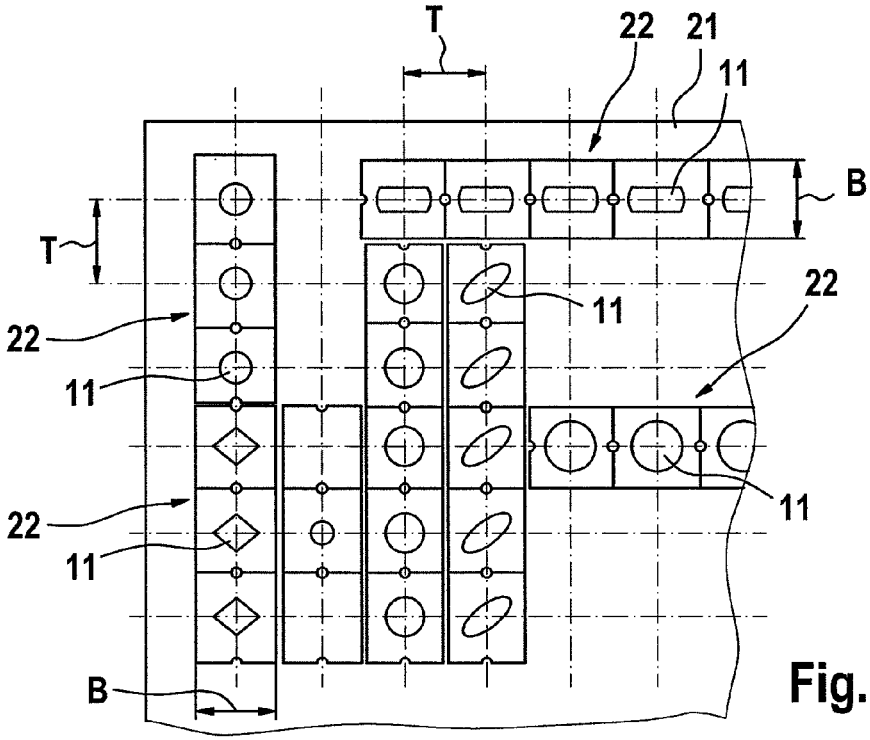
Figure 5:
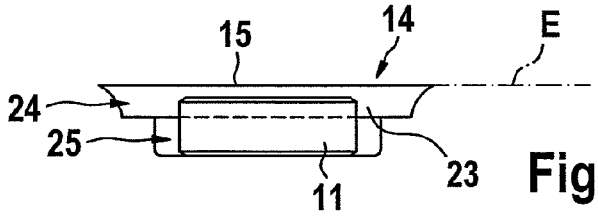
Figure 6:
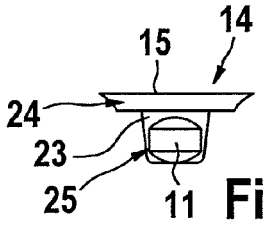
Figure 7:
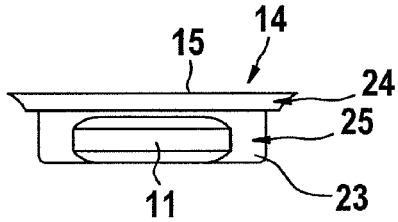
Figure 8:
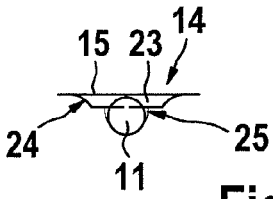
Figure 9:
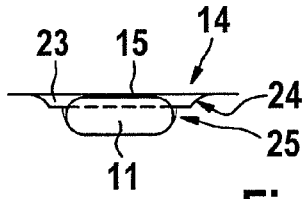
Figure 10:
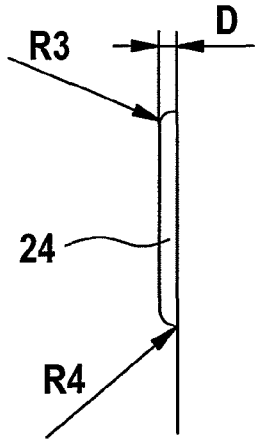
Figure 11:
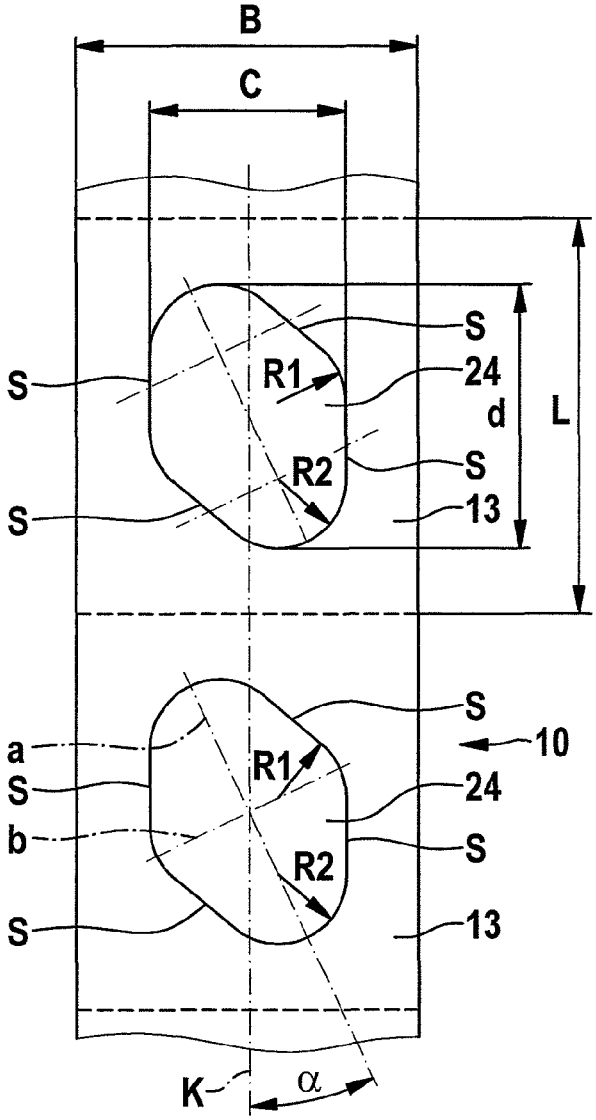
Figure 12:
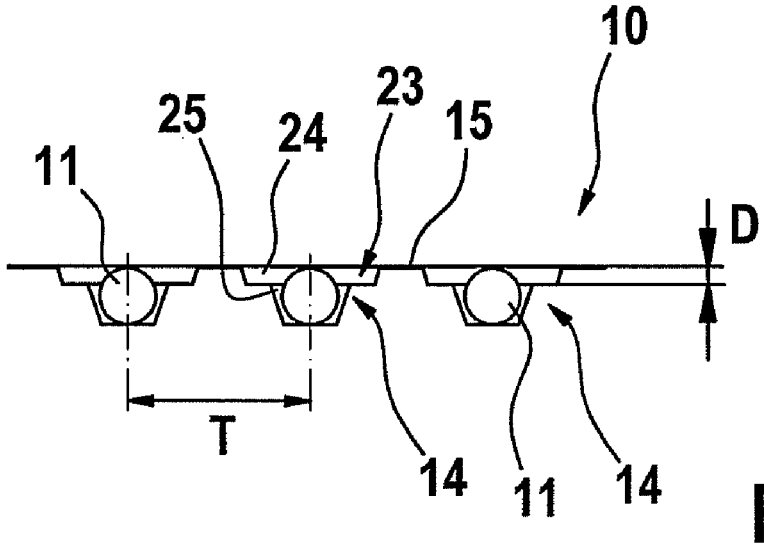
Figure 13:
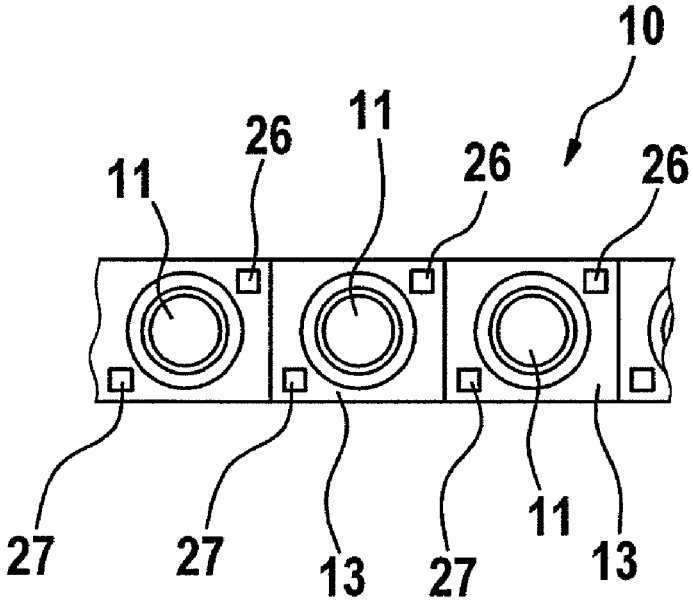

Further appropriate or advantageous features and developments are apparent from the subsidiary claims and the description. Particularly preferred embodiments are described in more detail with the aid of the attached drawings. The drawings show:

FIG. 1 a top view of a single-web blister strip,

FIG. 2 a top view of a further embodiment of a blister strip,

FIG. 3 a top view of a further embodiment of a blister strip,

FIG. 4 a top view of a substrate mounted with several blister sections,

FIG. 5 a side view of a two-stepped nest according to the invention in section with a tablet, FIG. 6 a side view of a further nest in section with an oblong, FIG. 7 a front view of the nest according to FIG. 6, FIG. 8 a side view of a further nest in section with a capsule, FIG. 9 a front view of the nest according to FIG. 8, FIG. 10 a side view of the depression independent of the product geometry, FIG. 11 a top view of the depression according to FIG. 10, FIG. 12 a side view of a blister section with three two-stepped nests in section, and FIG. 13 a top view of the blister section according to FIG. 12.

DETAILED DESCRIPTION

The invention concerns different variants of blister strips which are particularly suitable for being assembled into a patient-individual pack.

A blister strip 10 according to the invention as shown in FIG. 1 serves to receive medical and/or pharmaceutical and/or food supplement products 11. The products 11 can be designed as tablets, oblongs, capsules or in some other form for administration. The blister strips 10, which are basically designed in a single web, comprise a roll-up product carrier 12 which is usually made of polyvinyl chloride (PVC) or a material with comparable properties and can be divided into individual blister sections 13.

In the direction of transport F of the blister strip 10 or product carrier 12, the direction of transport F in particular referring to unrolling during preferably automated mounting, the product carrier 12 has individual nests 14 one behind the other which serve to receive separate products 11. The nests 14 or the distances between them, which define the division T of the blister strip 10, are closed with a film-like cover 15 which is preferably made of aluminium or a material with comparable properties, so that each individual product 11 within the nest 14 is completely shielded from the environment.

Each blister strip 10, regardless of the type of filling or the products assigned to the nests 14, has a division T, that is, the distance from nest centre to nest centre. Preferably, a blister section 13 is rectangularly shaped. The length L of a blister section 13, that is, the side edge length of a blister section 13 carrying a product 11, in the direction of transport F is usually longer than the width B of the blister strip 10. Naturally, a blister section 13 can have other shapes as well. For instance, the length L can correspond to the width B of the blister strip 10, so that the blister sections 13 are square-shaped.

In this case the geometrical dimensions of the blister strip 10 or of the individual blister sections 13 are independent of the product. To put it another way, the blister strips 10 or blister sections 13 have common, standardised dimensions for all different products 11. Each blister section 13 has precisely one nest 14 which is designed to receive a single product 11. Naturally, several blister sections 13 joined together to form a string of blister sections can also be separated from the blister strip 10. The nests are oriented centrally on each or in each blister section 13. This means that the centre of a nest 14 lies over or on the centre of a blister section 13. Other positions of the nests 14 on the blister section 13 are however possible as well.

Optionally, between the nests 14 is formed a positioning aid 17. The positioning aid 17 can be formed between two nests 14 in the direction of transport F of the blister strip 10, the positioning aid 17 being a hole in the present example. The design and position of the positioning aid 17 can of course vary. Other in particular optically detectable or readable markings are also possible as the positioning aid 17. Preferably, however, the hole relating to the width B of the blister strip 10 is always arranged in a predefined and constant position relative to the nest 14. The hole can be arranged centrally e.g. relating to the width B of the blister strip 10. Furthermore, a perforation 18 or the like can run between adjacent blister sections 13 transversely to the direction of transport F. The perforation 18 can be formed by weakening the material e.g. by hole perforation, material reduction, etc. Preferably the perforation 18 extends across the full width B of the blister strip 10, but can also extend only partly across the width B. In the embodiment shown, the perforation 18 runs through the hole.

Laterally in the direction of transport F, the blister strip 10 can optionally be free from perforations as shown in FIGS. 1 and 2, or provided with a perforation 19 as shown in FIG. 3. The perforation 19 can be one-sided or double-sided, and serves for guided transport of the blister strips 10 for example in automatic mounting machines. The perforation 18 for separating individual blister sections 13 from each other, for example with a theoretical cut with a blade, can, as FIG. 2 shows, also be designed as a perforation region 20. By a double cut or a cut with a double blade, on separation of the blister sections 13 each blister section 13 is shortened by a small amount in its length L, with the result that optimum placement of the blister sections 13 without overlap on a substrate 21 or the like can be achieved. As can be seen from FIG. 4, various blister sections 13 or strings of blister sections 22 formed from them with different products 11 can be placed in the longitudinal and/or transverse direction on the substrate 21. Due to the constant and/or identical division and width ratios of all blister sections 13, all nests 14 with the most varied products 11 are located at predefined and standardised positions, such that, in spite of the different products 11, a uniform format can be used for a cover element (not shown). Due to the possibility of nesting in the longitudinal and transverse directions, a space-saving arrangement of the strings of blister sections 22 on the substrate 21 is guaranteed. This nesting is guaranteed with both square and rectangular or otherwise shaped blister sections 13 or corresponding strings of blister sections 22.

The design of the nests 14 themselves according to the invention is described in more detail with the aid of FIGS. 5 to 11, which show different nests 14 on different scales. Each nest 14 has an exactly two-stepped holding chamber 23. This means that the product carrier 12 in the region of each nest 14 has two depressions with different dimensions. In the preferred embodiment, the nest 14 is composed of a depression 24 independent of the product geometry, and a depression 25 dependent on the product geometry.

The depression 25 adapted to the product geometry is arranged, starting from the cover 15 which spans a plane E, behind the depression 24 which is independent of the product geometry. In this case the product-independent depression 24 is larger in its cross-section running parallel to the cover 15 (that is, in a top view) than the product-dependent depression 25 in the corresponding cross-section. Within the depression 25 which has product-specific dimensions, the product 11 is held centrally in relation to the nest 14, so that the pressure exerted when the products 11 are pushed out acts directly on the product 11. The product-independent depression 24, which determines the size of the opening in an associated cover element (not shown) of a pack, is selected identically in its cross-sectional geometry for all products 11 and all nests 14.

The two depressions 24, 25 therefore form the two-stepped holding chamber 23. In other words, the product-independent depression 24 forms a universal preliminary area, while the product-dependent depression 25 forms a special product area. The depth D of the product-independent depression 24 is of particular importance. On the one hand, the depth D is large enough for the blister strip 10 to be capable of being laterally guided mechanically along the product-independent depression 24. On the other hand, the depth D is smaller than the thickness of the smallest product 11 to be received. Here, the thickness of the product 11 in its edge region is particularly important. This means firstly that a peripheral edge section formed by the depression 24 and perpendicular to the plane E has a height which allows reliable mechanical guiding along the edge section. Secondly, the selected depth D of the depression 24 in relation to the product thickness allows reliable holding of the products 11 in the product-dependent depression 25. The depth D is within a selected range of approximately 1.2 mm to 2.5 mm, and is preferably 2 mm. Minor deviations within the tolerance range are, however, also permitted.

The shape of the product-independent depression 24 is also of particular importance, the shape affording independent advantages on its own or in combination with the selected depth range of the depression 24. The shape of the depression 24 means in particular the cross-section of the product-independent depression 24 running parallel to the cover 15. The cross-section is formed and designed in a section parallel to the plane E geometrically for receiving the most varied product types. In other words, the outer edge of the depression 24 in cross-section describes a shape which is optimised in such a way that the most varied product shapes and/or product sizes can be received in the correspondingly constructed product-dependent depression 25. In plan view, the depression 24 corresponds to a lozenge with rounded corners. In order to describe the shape of the cross-section of the depression 24, the outer edge of the depression 24 can also be described by an oval web with a circle web mounted centrally over it, the diameter of the circle being larger than the minor axis of the oval. In the transition region of the two geometrical bodies, the web is smoothed.

The shape of the product-independent depression 24 can also be described as follows. The outer contour shown in particular in FIG. 11 for the cross-section of the product-independent depression 24 running parallel to the cover 15 is composed of several part-sections. The outer contour of the depression 24 is spanned by two sections a and b intersecting at right angles. Section a forms the longitudinal axis of the cross-section of the depression 24 and is inclined at an angle $\alpha$ to an axis K extending in the longitudinal direction of the blister strip 10. The angle $\alpha$ is between 14° and 21° and preferably between 16° and 18°, particularly preferably between 16.5° and 17.5°. FIG. 11 is a schematic view of an arrangement and design of the contour of the preliminary area, the drawing not being true to scale. The angle $\alpha$ shown in FIG. 11 is to be approximately 16.7° in a preferred embodiment. An inclination within the above range, in particular in the range which is indicated as preferred and particularly within the range which is indicated as particularly preferred, makes it possible also to receive elongate products 11 in the nest 14 if a blister section 13 has a relatively short length L. With an angle $\alpha$ of approximately 16.7°, an optimum arrangement of section a of the cross-section of the depression 24 of the blister section 13 is achieved, and ease of filling the nest 14 is still guaranteed.

Section b forms the transverse axis of the cross-section of the depression 24 and is arranged at right angles to section a. Section a and section b intersect each other halfway along section a or b. The ratio of the length of section b to the length of section a is preferably 0.55 to 0.75, and particularly preferably 0.6 to 0.7. With these ratios, particularly with the particularly preferred ratio, it is made possible to receive both elongate and round products 11 with minimised free spaces. In the practical example shown in FIG. 11, the ratio is approximately 0.656, the length of section a is approximately 25.9 mm and the length of section b is approximately 17 mm.

In each case at the end of section b, the outer contour of the depression 24 composed of part-sections forms an arc having a radius $R_1$. In each case at the end of section a, the outer contour of the depression 24 composed of part-sections forms an arc having a radius $R_2$. The radius $R_1$ is preferably 6 to 10 mm, particularly preferably 7 to 9 mm. In the practical example shown in FIG. 11, the radius $R_1$ is approximately 8 mm. The radius $R_1$ behaves in proportion to the radius $R_2$ in the order of magnitude of approximately 1.2 to 1.3. This means that the radius $R_2$ is between 6 mm and 7 mm and preferably approximately 6.5 mm. A radius $R_1$ within the above ranges, particularly within the particularly preferred range, ensures that the most varied products 11 are received while at the same time the free spaces in the nest 14 are minimised. Hence only minimal air quantities are trapped, which increases the so-called shelf life. As a result, products 11 received in the nest 14 can therefore be kept in stock for a longer time without having to fear any impairment of quality.

Further part-sections of the composite outer contour of the cross-section of the depression 24 form—in addition to the two arcs with the radii $R_1$ at the ends of the transverse axis (section b) and the two arcs with the radii $R_2$ at the ends of the longitudinal axis (section a)—sections S of four tangents which are applied firstly to an arc of radius $R_1$ and secondly to an arc of radius $R_2$. The above-mentioned sections S extend in each case from the point of contact of the corresponding tangent with the arc of radius $R_1$, to the point of contact of this tangent with the arc of radius $R_2$. The above-mentioned outer contour therefore results from assembling two mutually opposed arcs of radius $R_1$ and two mutually opposed arcs of radius $R_2$ as well as four rectilinear sections S connecting these arcs to each other, of tangents applied to the pair of arcs (of radii $R_1$ and $R_2$).

Advantageously, a rectilinear section S connecting an arc of radius $R_1$ and an arc of radius $R_2$ is arranged parallel to the longitudinal extent of the blister strip 10 or blister section 13. To put it another way, at least one section S runs parallel to the side edge of the blister strip 10. With such an arrangement of a connecting section S, this section S forms a wall which is particularly well suited to guiding the blister strip 10, for example along a filling station with a guide rail. In this case, as a result of the relatively long guide surface formed by the wall, a low surface pressure is obtained, which makes it possible to work with particularly thin wall thicknesses. This in turn allows low material consumption. If the radii $R_1$ and/or $R_2$ are increased so as to merge with each other, as it were, until such a connecting section S is eliminated, there is of course an increase in the risk of damage due to increased surface pressure during conveying, but this can be reduced by a suitable choice of wall thicknesses.

The length d of the outer contour of the cross-section of the depression 24 projected transversely to the longitudinal extent of the blister strip 10 or blister section 13 is preferably 22 to 28 mm, particularly preferably 23 to 27 mm. In a practical example shown in FIG. 11, the length d is approximately 25 mm. The width c of the outer contour of the cross-section of the depression 24 projected longitudinally of the longitudinal extent of the blister strip 10 or blister section 13 is preferably 14 to 20 mm, particularly preferably 15.5 to 18.5 mm. In the practical example shown in FIG. 11, the width c is approximately 17 mm. If the length D and width c are within the ranges indicated above, particularly within the particularly preferred range, a large number of the most varied geometries of products 11 can be received in the nests 14 with minimised free spaces.

For easier and sturdier forming of the depression 24 and at the same time a good guiding facility during filling, two radii $R_3$ and $R_4$ are provided. The radius $R_3$ at the protruding, free step of the depression 24 is preferably 0.7 to 0.9 mm, particularly preferably 0.75 to 0.85 mm. In the practical example shown in FIG. 10, the radius $R_3$ is approximately 0.8 mm. At the transition from the depression 24 to the blister base is provided the radius $R_4$ which is preferably 0.2 to 0.4 mm, particularly preferably 0.25 to 0.35 mm. In the practical example shown in FIG. 10, the radius $R_4$ is approximately 0.3 mm.

Each nest 14 is optionally in addition assigned a further positioning aid 26 (see FIG. 13), the position of the positioning aid 26, which can for example be designed as a punched hole, being fixed in relation to the position of the nest 14. But other markings are also possible as a positioning aid 26, in particular optically detectable or readable markings. In addition to the positioning aid 26, each nest 14 or each blister section 13 can be assigned a code 27. The code 27 contains information on the corresponding nest 14 as well as the product 11 located in it. Furthermore, the blister strip 10 can also have a central code (not shown) on top, which contains information on the blister strip 10 itself (for example, date of manufacture, etc.).

Below, the principle of the method for the manufacture of a blister strip 10 according to the invention as well as a pack composed of individual blister sections 13 or strings of blister sections 22 is described in more detail. On a deep-drawing machine or the like, a so-called bottom film of PVC which constitutes the product carrier 12 is unwound from an endless roll and delivered to a deep-drawing station which is essentially composed of a preheating means, a blow head and a deep-drawing mould. The respective nest 14 is formed e.g. by means of compressed air. Formation of the nest 14 can also be done at least partially by a stamp or the like. For the multi-step nest 14, accordingly several of the forming steps are necessary successively or simultaneously.

When the blister strip 10 or the bottom film designed as the product carrier 12 is made, the nests 14 are filled with products 11, the nests 14 of a blister strip 10 each being filled with identical products 11. However, different products 11 can be put in a blister strip 10. Basically, each nest 14 is filled with only one product 11. Filling can optionally be checked by inspection systems or the like. Also, preferably manual subsequent filling of empty nests 14 can take place. Next the filled and checked blister strip 10 is closed or sealed with the film-like cover 15, namely a covering film made of aluminium or the like. Furthermore, a hole-punching station or the like is provided. After forming and sealing of the nest 14, a punched hole is made in the bottom film/covering film in the region of each nest 14 as a positioning aid 26. After applying the covering film, a perforation 18 can be made transversely to the direction of transport F of the blister strip 10. As a result, selective separation of individual blister sections 13 from the blister strip 10 is made easier.

Next, in the region of each nest 14 is applied a code 27 which allows identification of the contents of the nest 14. For example, from the bottom film side a two-dimensional matrix code is incorporated in the bottom film by laser. Naturally, other methods of application and other means of identification are possible.

Manufacture as described can also take place in parallel for several blister strips 10 joined together, separation in the longitudinal direction of the blister strips 10 taking place after the steps described. In other words, a web consisting of several, e.g. five tracks can be divided into five individual blister strips 10. To guide the tray consisting of e.g. five webs, the product-independent depressions 24 are used. After separation into individual blister strips 10, the side edges can be trimmed, so that blister strips 10 with the same width are formed.

The invention claimed is:

1. A blister strip for receiving at least one of individual medical, pharmaceutical, or food supplement products of varying sizes, comprising:

a roll-up single-web product carrier dividable into individual blister sections, the single-web product carrier having individual nests aligned in a direction of transport to receive the individual products, and a film cover to close the nests, each individual product being arranged in sealed form within a nest, each nest having a two-stepped holding chamber comprising a top depression independent of the product geometry and neighboring the film cover, and a bottom depression dependent on the product geometry to hold the individual product, wherein the top depression has a depth great enough that the blister strip is laterally guidable mechanically along the top depression during automated manufacture, and less than the thickness of the smallest individual product to be received within the nest, wherein an outer contour of the top depression is spanned by a first section and a second section intersecting at right angles, wherein the first section forms a longitudinal axis of a cross-section of the top depression and is inclined at an angle to an axis extending in a longitudinal direction of the blister strip, wherein the angle is between 14 degrees and 21 degrees, wherein the second section forms a transverse axis of the cross-section of the top depression, and wherein a ratio of the length of the second section to the length of the first section is 0.55 to 0.75.

2. The blister strip according to claim 1, wherein the cross-section of the top depression is adapted to be parallel to the film cover that is larger than the bottom depression.

3. The blister strip according to claim 1, wherein the top depression has a cross-sectional geometry running parallel to the film cover that is identical for all products carryable by the blister pack.

4. The blister strip according to claim 1, wherein the top depression has a depth of not less than about 1.2 mm and not greater than about 2.5 mm.

5. The blister strip according to claim 1, wherein the cross-section of the top depression is adapted to be parallel to the cover that is geometrically shaped and designed to receive product types that are most variable.

6. The blister strip according to claim 1, the cross-section of the top depression is adapted to be parallel to the cover that corresponds to a lozenge with rounded corners.

7. The blister strip according to claim 1, wherein the blister sections have geometrical dimensions that are independent of the product.

8. The blister strip according to claim 1, wherein each nest is arranged centrally on or in a respective one of the blister sections.

9. The blister strip according to claim 1, wherein each nest has a first positioning aid having a position that is fixed relative to the nest.

10. The blister strip according to claim 9, further including one further positioning aid located between two adjacent nests in the direction of transport of the blister strip.

11. The blister strip according to claim 10, wherein the further positioning aid in relation to a width of the blister strip is arranged in a predefined and constant position relative to the nest.

12. The blister strip according to claim 1, wherein one of each nest or each blister section is assigned a code.

13. The blister strip according to claim 12, wherein the code comprises at least one of an optically and electronically detectable field.

14. The blister strip according to claim 1, further including a superordinate, central code associated with the blister strip.

* * * * *